US007824507B2

(12) United States Patent
Van Daam et al.

(10) Patent No.: US 7,824,507 B2
(45) **Date of Patent: *Nov. 2, 2010**

(54) METHOD FOR PREPARING NANOSTRUCTURED METAL ALLOYS HAVING INCREASED NITRIDE CONTENT

(75) Inventors: Thomas J. Van Daam, Simi Valley, CA (US); Clifford C. Bampton, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 29 days.

This patent is subject to a terminal disclaimer.

(21) Appl. No.: 12/019,758

(22) Filed: Jan. 25, 2008

(65) Prior Publication Data

US 2008/0138240 A1 Jun. 12, 2008

Related U.S. Application Data

(62) Division of application No. 10/388,059, filed on Mar. 12, 2003, now Pat. No. 7,344,675.

(51) Int. Cl.
*C22C 29/16* (2006.01)
*B22F 9/04* (2006.01)

(52) U.S. Cl. ..... 148/317; 148/437; 75/352; 419/13

(58) Field of Classification Search ..... None
See application file for complete search history.

(56) References Cited

U.S. PATENT DOCUMENTS 4,619,699 A 10/1986 Petkovic-Luton et al.
4,818,481 A 4/1989 Luton et al.
5,116,438 A 5/1992 Darolia et al.
5,635,654 A 6/1997 Hebsur et al.
5,725,691 A 3/1998 Liu
6,042,631 A 3/2000 Kondoh et al.
6,454,992 B1 9/2002 Hebsur
6,848,163 B2 2/2005 Bampton et al.
6,902,699 B2 6/2005 Fritzemeier et al.
7,354,490 B2 * 4/2008 Fritzemeier et al. ..... 148/437

OTHER PUBLICATIONS

Oddvar Suseggt, Einar Hellum, Arne Olsen, and Michael J. Luton, HREM Study of Disperoids in Cryomilled Oxide Dispersion Strengthened Materials, Philosophical Magazine, 1993, pp. 367, 377, and 380, vol. 68 No. 2, Taylor & Francis Ltd.

I. Lucks, P. Lamparter, and E. J. Mittemeijer, Uptake of Iron, Oxygen and Nitrogen in Molybdenum During Ball Milling, 2001, Acta mater. 49 (2201) 2419-2428.

(Continued)

*Primary Examiner*—George Wyszomierski
(74) *Attorney, Agent, or Firm*—Alston & Bird LLP

(57) ABSTRACT

A method of producing high strength nanophase metal alloy powder by cryomilling metal powder under conditions which cause the formation of intrinsic nitrides, and of producing high strength metal articles by subjecting the nitrided cryomilled powder to thermo-mechanical processing. The intrinsic nitrides present within the alloy significantly reduce grain growth during thermo-mechanical processing, resulting in formed metal products of high strength and improved ductility.

20 Claims, 3 Drawing Sheets

OTHER PUBLICATIONS

M. A. Bab, L. Mendoza-Zelis and L. C. Damonte, Nanocrystalline HfN Produced by Mechanical Milling: Kinetic Aspects, 2001, Acta mater. 49 (2001) 4205-4213.

X. Zhang, H. Wang, J. Narayan and C. C. Koch, Evidence for the Formation Mechanism of Nanoscale Microstructures in Cryomilled Zn Powder, Acta mater. 49 (2001) 1319-1326.

V.L. Tellkamp, S. Dallek, D. Cheng, and E.J. Lavernia, Grain Growth Behavior of a Nanostructured 5083 A1-Mg Alloy, 2001 Materials Research Society, Apr. 2001, pp. 938-944, vol. 16 No. 4, J. Mater. Res.

* cited by examiner

METHOD FOR PREPARING NANOSTRUCTURED METAL ALLOYS HAVING INCREASED NITRIDE CONTENT

CROSS REFERENCE TO RELATED APPLICATION

This application is a divisional of U.S. patent application Ser. No. 10/388,059, filed Mar. 12, 2003, now U.S. Pat. No. 7,344,675, which is hereby incorporated herein in its entirety by reference.

FIELD OF THE INVENTION

The present invention relates to the production of high strength cryomilled metal alloys. Further, the invention relates to a method of manipulating the nitrogen input to an alloy during cryomilling.

BACKGROUND OF THE INVENTION

Nanostructured alloys, those having grain size smaller than $10^{-7}$ meter, often exhibit improved hardness, strength, ductility, diffusivity, and soft magnetic properties in comparison to traditional heat precipitation and dispersion strengthened alloys.

As with traditional alloys, nanostructured alloys undergo the processes of recovery, recrystallization, and grain growth upon heating. Recovery is the relief of a portion of the stored internal energy of a material after it has been plastically deformed through dislocation motion. Recrystallization is the formation of new, strain-free, equiaxed grains from previous strain hardened grains, driven by stored internal energy of the strained grains. Grain growth reduces the overall stored energy of the alloy by reducing the number of high-energy grain boundaries.

Nanostructured alloys are most often prepared by high-energy ball milling. In room temperature ball milling, the localized high temperatures encountered during collision of the balls causes recovery within the alloy, which counters the effect of further deformation. To prevent such recovery, nanostructured alloys are processed under cryogenic conditions, i.e. cryomilling, such as in a bath of liquid nitrogen, which effectively cold-works the particles. The cold-working introduces numerous dislocations, which form subgrain boundaries, and eventually high-angle grain boundaries with grain sizes on the order of nanometers.

During cryomilling, the grain size of the metal does not decrease indefinitely. Eventually, the grain size of the metal reaches an equilibrium state after which no amount of cold working will decrease the grain size of the metal below the equilibrium grain size. Equilibrium grain diameters as small as approximately $2.5\times10^{-8}$ meter have been observed via electron microscopy and measured by x-ray diffraction at this stage in processing. After cryomilling, the metal powders are nanostructured alloys that have high-ductility and a low recrystallization temperature.

To create a useful metallic article out of the cryomilled powder, the powder is consolidated and thermo-mechanically processed into a solid, dimensionally desirable form. An exemplary thermo-mechanical process is hot isostatic pressing (HIPping), and other thermo-mechanical techniques are known in the art of metal working.

During HIPping, and any subsequent extrusion and/or forging of the metal, recovery, recrystallization, and grain growth each occur within the metal article. These changes have, heretofore, been considered an unavoidable consequence of the thermo-mechanical processing that may negatively effect the qualities of the resulting article.

It is desired to provide a method of producing a high strength metal alloy having improved qualities over and above those metal alloys created from traditional cryomilled metal powders. It is further desired to provide a method of producing a metal alloy having improved qualities over those metal alloys created by using traditional thermo-mechanical processes to treat traditional cryomilled alloys.

SUMMARY OF THE INVENTION

The invention provides a method of producing high strength nanophase metal alloy powder by cryomilling metal powder under conditions that cause the formation of intrinsic nitrides. Further, the invention provides a method of producing high strength metal articles by subjecting the invented cryomilled powder to thermo-mechanical processing. The intrinsic nitrides present within the alloy have been found to significantly reduce grain growth during thermo-mechanical processing. The alloys produced by the invented method exhibit high strength and improved ductility, superior to nanophase alloys produced by previous methods of cryomilling and heat treatment.

The inventors have recognized that some metals favorably form stable nitrides during cryomilling with liquid nitrogen, and that by controlling different parameters of the cryomilling, the amount of nitride formation may be controlled. The inventors have also recognized that the formation of stable nitrides during cryomilling has the effect of reducing subsequent grain growth during heat treatment or thermo-mechanical processing of the cryomilled alloy. This reduction in grain growth improves the overall characteristics of the resulting alloy in comparison to similar alloys cryomilled and treated using conventional techniques.

The nitrides formed during cryomilling are termed "intrinsic nitrides". These intrinsic nitrides are formed from the combination of the nitrogen from the liquid nitrogen bath and at least one metal element of the alloy being cryomilled. The intrinsic nitrides of the invention are distinct from the extrinsically added metal nitride particles which may be premixed with the metals as dispersoids, such as the refractory nitrides, oxy-nitrides, or boron-nitrides. Unlike previous methods of introducing nitrides as refractory materials (see for instance U.S. Pat. Nos. 4,619,699 and 4,818,481), the invented method controls the formation of nitrides within the alloy, and is not concerned with the simple addition of previously formed nitrides.

It has previously been known that cryomilled alloys reach an equilibrium grain size after a certain amount of cryomilling. However, nitride formation in accordance with the invention does not necessarily cease when the equilibrium grain size of the cryomilled alloy is reached. It has been found that nitride formation may be steadily increased in a number of metals by continually cryomilling those metals and alloys of the metals, even after the nanostructured grains of the alloys have reached an equilibrium grain size. As an example, for aluminum alloys, the point at which the equilibrium grain structure was reached tends to correspond to the point at which approximately 0.3 wt % to 0.6 wt % of nitrogen has been added to the alloy by nitriding. However, additional nitrides may be formed by cryomilling beyond the equilibrium grain structure. The amount of nitrogen added is only limited by the practical consideration that ductility is diminished at high nitrogen content. For instance, alloys which are primarily aluminum tend to become brittle at nitrogen contents of 1.0 wt % or higher.

Under the extreme conditions of cryomilling, intrinsic nitrides will form with most metallic components. However, for the purposes of this invention, stable nitrides are formed with metals and alloys having negative enthalpies of formation with nitrogen. These metals, including but certainly not limited to aluminum, lithium, magnesium, iron, molybdenum, chromium, vanadium, niobium, tantalum, titanium, zirconium, and hafnium, tend to form stable compounds with nitrogen as the nitrogen is introduced to the metal during cryomilling.

It is important that the nitrides formed during cryomilling be particularly stable or the nitrides tend to decompose during thermo-mechanical processing of the alloys, thereby reducing any inhibitory effect upon grain growth. In general, those metals having a large enthalpy of formation with nitrogen form nitrides which resist decomposition during thermo-mechanical processing. Introduction of these stable intrinsic nitrides produces a material that most favorably inhibit grain growth.

Though not wishing to be bound by theory, it is believed that the intrinsic nitrides decrease grain growth and increase strength of the resulting metal due to small nitride particles of about 5 nanometers forming within the grains or grain boundaries, rather than as part of the aluminum lattice or as large precipitated particles previously known in the art. The extraordinary strength and the ability of the alloy to maintain high strength at extremely low temperatures are believed to be due to the unique grain structure, grain size, and interaction of constituents of the alloy caused by the cryomilling process. The improved physical properties of the alloy are exhibited when the alloy powder is compressed and extruded into a solid metal component.

The alloys produced with the invented method show dramatic improvements in several areas over cryomilled alloys of the past. First, the increased amount of nitrogen introduced by this method tends to pin grains and prevent grain growth as temperature of the alloy is increased. This allows working of the alloy at higher temperatures. Second, the nitrides tends to increase strengthening within the alloy by stopping dislocations within the grains. Third, the nitrides inhibits grain boundaries from moving. Finally, nitrides formed during cryomilling tend to reduce grain growth during subsequent extrusion, forging, and rolling of the metal produced thereby.

Cryomilling the alloys in accordance with this invention provides a resultant metallic powder having a very stable grain structure. The average grain size within the alloy is less than 0.5 μm, and alloys with average grain size less than 0.1 μm may be produced. The small, stable grains of the alloy allow the formation of components, using thermo-mechanical processes, that exhibit significantly improved strength over similar alloys produced by other methods.

The control of intrinsic nitride formation during cryomilling, and the use of the intrinsic nitrides to control grain growth during thermo-mechanical processing of the metal, have heretofore been unknown.

BRIEF DESCRIPTION OF THE DRAWINGS

Figure 1:
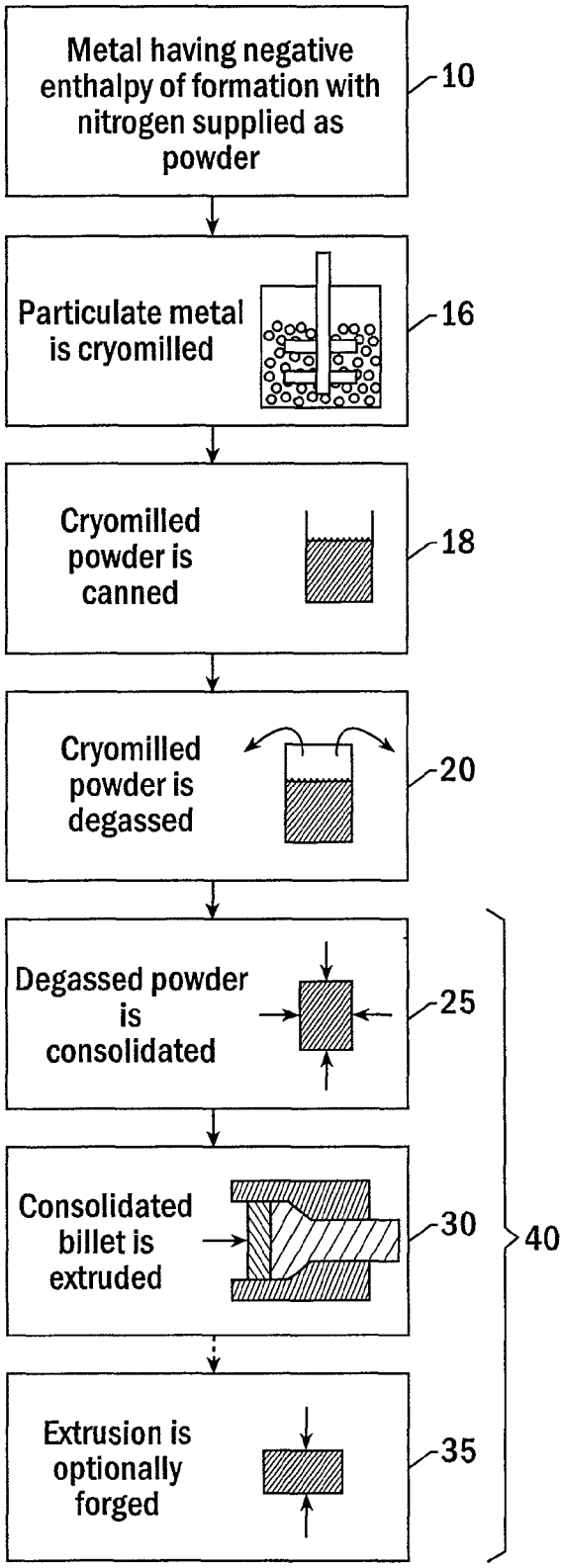
Figure 2:
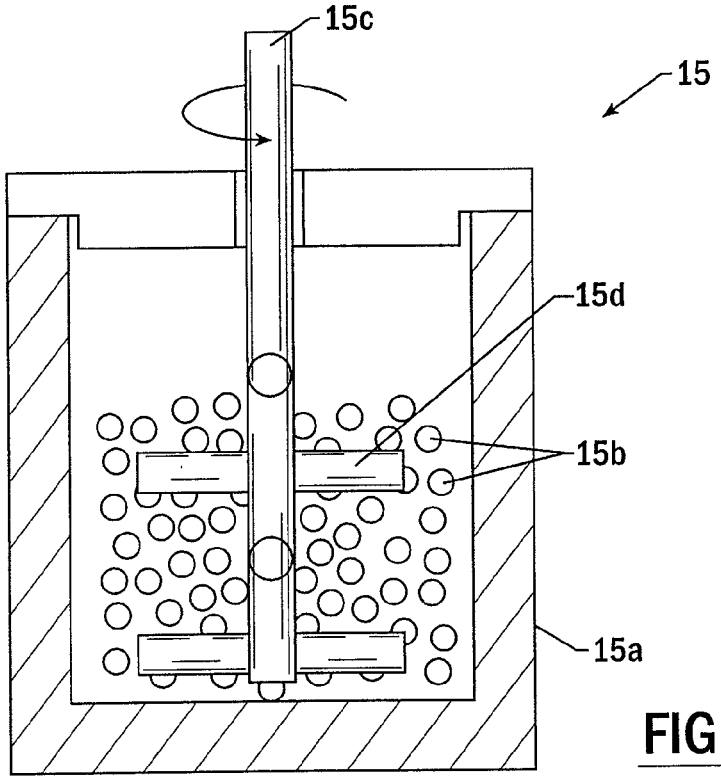
Figure 3:
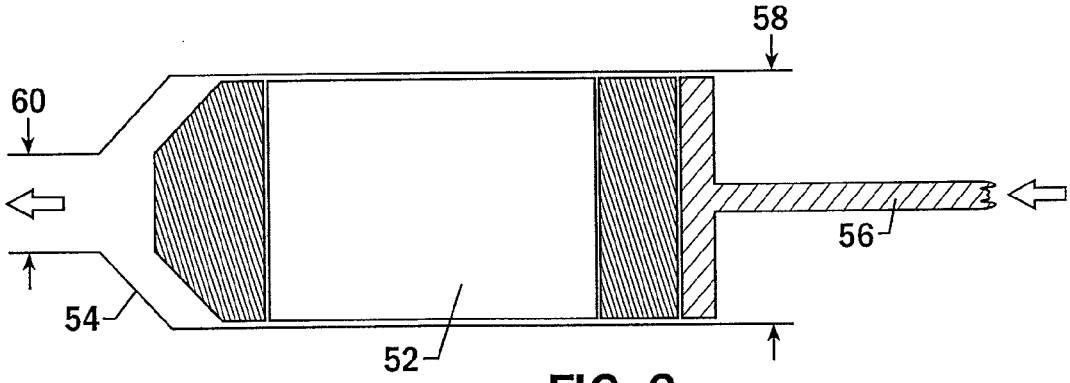
Figure 4:
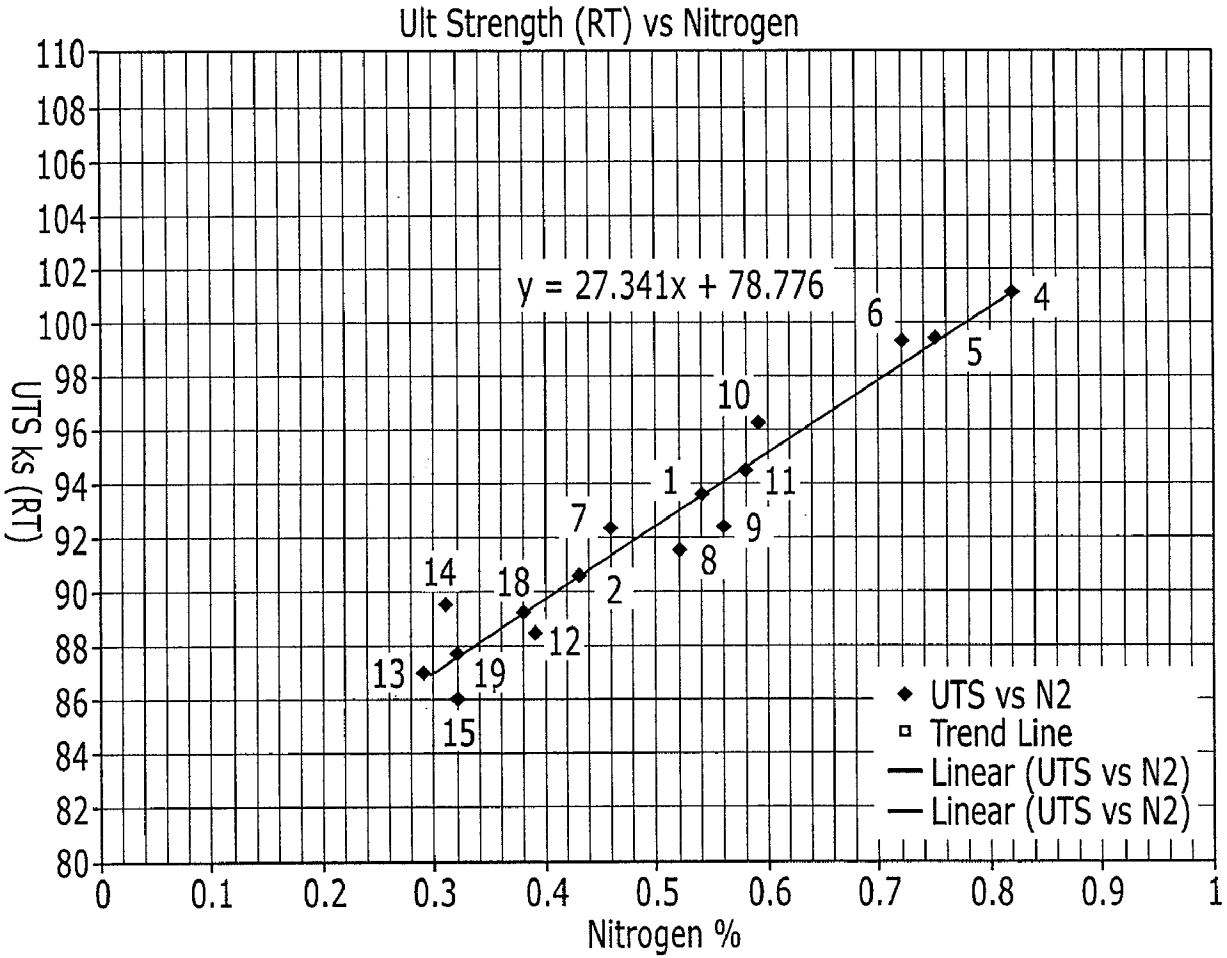

Having thus described the invention in general terms, reference will now be made to the accompanying drawing, which is not necessarily drawn to scale, and wherein:

FIG. 1 is a schematic flow diagram of a method in accordance with an embodiment of this invention;

FIG. 2 is a side sectional view of an exemplary ball mill and attritor for use in an embodiment of this invention;

FIG. 3 is a side sectional view of an exemplary extrusion apparatus in accordance with an embodiment of the invention; and FIG. 4 is a plot showing an increase in tensile strength vs. nitrogen content of an aluminum alloy produced in accordance with an embodiment of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As used herein, "alloy" is used to collectively describe pure metals or alloys having at least one metal component that has a negative enthalpy of formation with nitrogen under cryomilling conditions. Some exemplary metals which have large negative enthalpies of formation with nitrogen, i.e. form stable nitrides, include but are not limited to aluminum, lithium, magnesium, iron, molybdenum, chromium, vanadium, niobium, tantalum, titanium, zirconium, and hafnium.

Table 1 shows a list of several metals capable of forming nitrides. The metals or alloys listed with negative numbers form stable nitrides. It is the stable nitrides that provide the beneficial inhibition on grain growth in accordance with this invention. The more negative the enthalpy of formation, the more stable the nitride formed.

TABLE 1

Enthalpies of Formation with Nitrogen

| Compound | $\Delta H_{298}$ 25° C. |
|---|---|
| A1N | −318.6 |
| BN | −254.1 |
| $Ba_3N_2$ | −341.1 |
| $Be_3N_2$ | −589.9 |
| $Ca_3N_2$ | −439.6 |
| $Cd_3N_2$ | 161.6 |
| CeN | −326.6 |
| $Co_3N$ | 8.4 |
| CrN | −123.1 |
| $Cr_2N$ | −114.7 |
| $Cu_3N$ | 74.5 |
| $Fe_4N$ | −10.9 |
| GaN | −109.7 |
| $Ge_3N_4$ | −65.3 |
| HIN | −369.3 |
| $NH_3$ | −46.1 |
| InH | −138.1 |
| LaN | −299.4 |
| $Li_3N$ | −196.8 |
| $Mg_3N_2$ | −461.8 |
| $Mn_4N$ | −126.9 |
| $Mn_3N_2$ | −201.8 |
| $Mo_2N$ | −69.5 |
| NbN | −234 |
| $Nb_2N$ | −248.6 |
| $Ni_3N$ | 0.8 |
| $Si_3N_4$ | −745.1 |
| $Sr_3N_2$ | −391.0 |
| $Ta_2N$ | −270.9 |
| TaN | −252.4 |
| $Th_3N_4$ | −1298.0 |
| TiN | −336.6 |

TABLE 1-continued

| Enthalpies of Formation with Nitrogen | |
|---|---|
| Compound | $\Delta H_{298}$ 25° C. |
| UN | −294.7 |
| $U_2N_2$ | −708.5 |
| VN | −217.3 |
| $V_2N$ | −264.5 |
| $Zn_3N_2$ | −22.2 |
| ZrN | −365.5 |

The alloy may contain any amount of refractory dispersoids added to the alloy prior to cryomilling, such as oxides, nitrides, borides, carbides, oxy-nitrides, and oxy-carbides. And, as with any alloys, the invented alloy may contain low concentrations of a variety of contaminants or impurities, typically below 1 wt %.

As used herein, "cryomilling" describes the fine milling of metallic constituents at extremely low temperatures in a liquid nitrogen environment. Cryomilling takes place within a high energy mill such as an attritor with metallic or ceramic balls. During milling, the mill temperature is lowered by using liquid nitrogen to a temperature of between −240° C. and −150° C. In an attritor, energy is supplied in the form of motion to the balls within the attritor, which impinge portions of the metal alloy powder within the attritor, causing repeated comminuting and welding of the metal.

The high-strength metal alloy powders, extrusions, and forgings of this invention begin as a pre-alloyed metal or as a combination of metals that have not been previously alloyed. The beginning alloy is provided in the form of small particulates or powder. When intimately combined, mixed, and milled, the components of the alloy form a solid solution that may contain amounts of metallic precipitate.

If the beginning metal powder is supplied as pre-alloyed, then it can proceed directly to the cryomilling process. Metal powders that have not been previously alloyed can also proceed to the cryomilling step, since the cryomilling will intimately mix the aluminum constituent with the other metallic constituent and thereby alloy the metals. Similarly, refractory materials may be dispersed within the alloy prior to cryomilling, or the cryomilling may be used to distribute the dispersoids throughout the alloy.

Referring now to FIG. 1, once the constituents of the alloy are selected 10, the combined or pre-alloyed metal powder is cryomilled 16. It is preferred that the cryomilling 16 of the very small particles of metal powder take place within a ball attritor.

As shown in FIG. 2, the ball attritor is typically a cylindrical vessel 15*a* filled with a large number of ceramic or metallic spherical balls 15*b*, preferably stainless steel. A single fixed-axis shaft 15*c* is disposed within the attritor vessel, and there are several radial arms 15*d* extending from the shaft. As the shaft 15*c* is turned, the arms 15*d* cause the spherical balls 15*b* to move about the attritor. When the attritor contains metal powder and the attritor is activated, portions of the metal powder are impinged between the metal balls 15*b* as they move about the attritor. The force of the metal balls 15*b* repeatedly impinges the metal particles and causes the metal particles to be continually comminuted and welded together. This milling of the metal powder effectively cold-works the metal.

Cold working imparts a high degree of plastic strain within the powder particles. During cold working, the repeated deformation causes a buildup of dislocation substructure within the particles. After repeated deformation, the dislocations evolve into cellular networks that become high-angle grain boundaries separating the very small grains of the metal. Grain diameters as small as approximately $2.5\times10^{-8}$ meter have been observed via electron microscopy and measured by x-ray diffraction at this stage in processing. Structures having dimensions smaller than $10^{-7}$ meter are commonly referred to as "nanostructured" or "nanophase".

Cold working in the presence of the liquid nitrogen also causes the formation of stable nitrides when the alloy contains metals that are ready nitride formers. The nitrides formed during cold working are formed as planes or sheets that are typically 2 to 3 atoms thick. The nitrides are formed on the clean exposed surfaces of the powder particles as the particles are fractured during cryomilling. The formation of the nitrides continues with the extent of cryomilling.

Stearic acid may be added as one of the components to be milled with the metal powder. It promotes the fracturing and re-welding of metal particles during milling, leading to more rapid milling, and leading to a larger fraction of milled powder produced during a given process cycle.

Referring again to FIG. 1, During milling 16, the metal powder is reduced to and held at low temperature by surrounding the metal with liquid nitrogen. Also, surrounding the metal powder in liquid nitrogen limits exposure of the metal powder to oxygen or moisture such that the metal powder is maintained in a substantially oxygen-free environment. In operation, the liquid nitrogen is placed inside the attritor and allowed to boil off until the metal particles and the attritor balls are cooled and submerged in the liquid nitrogen.

The operating parameters of the cryomilling 16 will depend upon the processing necessary to achieve optimum results for the particular alloy being cryomilled. Several factors which effect the rate of and extent to which nitrides form within the alloy include milling time, ball to powder ratio, fineness of the beginning powder particles, the extent to which the metal powder was pre-alloyed prior to cryomilling, and milling speed.

The length of time that a metal is cryomilled is one of the most convenient parameters that may be manipulated in order to control the degree of intrinsic nitride formation within the cryomilled alloy. In general, the amount of nitrides added to the alloy corresponds with the total cryomilling time, wherein longer cryomilling times result in greater nitride formation.

In the past, it was assumed that the highest strength, thermo-mechanically processed, metallic alloys were obtained from cryomilled metal powders that were milled for a time sufficient to reach an equilibrium nanostructure grain size within the metal. The inventors have found that the resulting strength of the thermo-mechanically processed alloy is more dependent upon the intrinsic nitride content than the equilibrium grain size of the cryomilled metal. Thus, to provide an alloy of increased strength, the metal is cryomilled under conditions such that an optimum level of intrinsic nitrides are formed within the metal by cryomilling, wherein the optimum level of nitrides is that which results in a metal having a desired grain size after being thermo-mechanically processed. The optimum nitride content may be reached prior to or subsequent to the cryomilling time that corresponds to the equilibrium grain structure, and does not necessarily correlate to the time required to reach the equilibrium grain structure.

By way of example, aluminum alloys have heretofore been cryomilled until their equilibrium grain structure was achieved. Any further processing was considered wasteful and inefficient. For typical aluminum alloys, the amount of intrinsic nitrides formed within the alloy corresponding to the formation of the equilibrium grain structures is observed to be about 0.3 wt % to 0.6 wt % nitrogen. Note, the nitride contents of the alloys are stated in terms of wt % nitrogen. It is difficult to directly measure the nitride content of an alloy, and nitrogen content has been found to directly correspond to nitride content of a nitride forming alloy. Therefore, wt % nitrogen is used as the measure of nitride content throughout this disclosure.

By continuing to cryomill the metal after the equilibrium grain structure has been reached, additional nitrides may be formed above 0.6 wt % nitrogen. For the production of a high strength aluminum alloy, it is preferred that the cryomilling be continued until the intrinsic nitrides formed within the alloy reach between 0.45 wt % and 0.8 wt % nitrogen, and more preferably about 0.5 wt % nitrogen. Of course, the amount of nitrides that results in the most advantageous thermo-mechanically processed metal will depend upon the particular aluminum alloy being cryomilled and the desired properties of the resulting alloy.

By way of example, under cryomilling conditions known in the art, aluminum can be cryomilled under conditions that achieve an equilibrium grain structure in about 8 hours. But, cryomilling aluminum on the order of 16 hours under the same conditions yields an alloy having approximately 1.3 wt % of intrinsically formed nitrides added during the cryomilling process. The ability to control the addition of these nitrides allows the production of thermo-mechanically processed aluminum having grain sizes and structures that were previously unachievable.

After cryomilling 16 but before thermo-mechanical processing 40, the metal alloy powder is a homogenous solid solution having an increased amount of added intrinsic nitrides from the cryomilling process 16, optionally having added refractory components and optionally having minor amounts of metallic precipitate interspersed within the alloy. Grain structure within the alloy is very stable and grain size is less than 0.5 μm. Depending on the alloy and extent of milling the average grain size is less than 0.3 μm, and may be lower than 0.1 μm.

After the metal alloy powder, with the proper composition, grain structure, and nitrogen composition, is produced, it is preferably transformed into a form that may be shaped into a useful object.

In accordance with one embodiment of the invention, the cryomilled metal powder is canned 18, degassed 20, and then consolidated 25, such as by use of a hot isostatic press (HIP). After the step of consolidating 25, the metal is a solid mass which may be worked and shaped. The consolidated metal is extruded 30 into a usable metal component, and forged 35 if necessary. Canning, degassing, compaction, extrusion, and forging of particulate alloys are known in the art and known methods may be used with the improved particulates of the invention.

Components formed from the metal alloy may be forged 35 if extrusion is not capable of producing a part of the proper shape or size. It is also desired to forge those components which need additional ductility in a direction other than the direction of extrusion. The combination of consolidation 25, extrusion 30, and any additional heating or working steps are referred to generally as thermo-mechanical processing 40.

For the first time, cryomilling parameters may be used to manipulate the nitride content of the cryomilled alloy such that the cryomilled alloy, in turn, results in a alloy of extremely high strength and small grain size after the cryomilled alloy has been subjected to thermo-mechanical processes.

EXAMPLES

Example 1

Production and Testing of Aluminum/Magnesium Alloy with 0.3%

Aluminum alloy powders of composition 6.7 wt % Mg+Al (balance) were cryomilled, canned, degassed, consolidated, and extruded into a 3" diameter bar. Cryomilling was carried out as follows. The attritor was filled with 640 kg grams of 0.25 inch diameter steel balls. Liquid nitrogen was flowed into the attritor. Flow was maintained for at least about one hour to cool the balls and attritor until the rate of boil off was sufficiently low to allow the balls to become completely submerged in the liquid nitrogen. A transfer hopper was loaded with 17445 grams of aluminum powder, 2555 grams of 50 wt % aluminum 50 wt % magnesium powder, and 40 grams of stearic acid. Loading of the hopper was carried out in a glove box under dry nitrogen purge. These components were transferred from the hopper into the attritor by draining from the hopper into a tube inserted through the lid of the attritor vessel. The attritor arms were then rotated in brief pulses to gradually move this powder metal charge down into the liquid nitrogen and steel balls.

Next, the attritor speed of rotation was increased to 100 RPM and maintained at 100 RPM for a time sufficient to increase the nitrogen content of the powder by 0.3 wt %, as measured with a Leco™ nitrogen analyzer, known in the industry. Liquid nitrogen level was maintained above the balls throughout the cryomilling period. At the end of the cryomilling period, the milled metal powder with liquid nitrogen was drained through a valve in the bottom of the attritor into steel bins. These bins were loaded into a glovebox, where the liquid nitrogen was allowed to boil off, which required approximately 6 to 10 hours. A dry nitrogen purge was maintained during and after boil off to avoid exposing the powder to air or moisture. Dry powder was weighted and packed into storage containers.

The dry powder was loaded into a can approximately 11 inch diameter by 7 inch long. A can lid was welded on to close and seal the can. The can was evacuated by a vacuum pump connected to tube welded to a port in the lid. The can was heated to approximately 600° F. while connected to the vacuum pump, to facilitate degassing of the can. The can was held at 600° F. until the vacuum, measured in the connecting tube, reached a level that indicated that degassing was nearing completion. The can was allowed to cool, then the evacuation tube was crimped and welded to seal the can.

Next, the can and powder were hot isostatic pressed (HIPped) at 600° F. and 15 ksi for 4 hours, consolidating the powder from about 65% to about 100%. The can was removed from the compacted powder billet via machining. The billet was then machined to a cylindrical shape, in preparation for extrusion. The billet was extruded through conical dies, from a diameter of about 9 inches, to a diameter of about 3 inches, at a temperature of about 400° F., at a ram speed of 0.02 inches per second.

Average grain size of the resulting extrusion was determined by Field Emission SEM (Scanning Electronic Microscope) to be 400 nm.

Example 2

Production and Testing of Aluminum/Magnesium Alloy with 0.45%

Aluminum alloy powders of composition 6.7 wt % Mg+Al (balance) were cryomilled, canned, degassed, consolidated, and extruded into a 3" diameter bar as described in Example 1 above, except that the powders were cryomilled at an attritor speed of 100 RPM for a time sufficient to increase the nitride content of the powder by 0.45 wt %.

Average grain size of the resulting extrusion was determined by Field Emission SEM (Scanning Electronic Microscope) to be 200 nm.

Comparison of the alloy extrusions of Examples 1 and 2 indicate that increased nitride content introduced by cryomilling of a metallic alloy corresponds to decreased grain growth during thermo-mechanical processing. The alloy with 0.3 wt % nitrogen as intrinsically formed nitrides resulted in an alloy, after thermo-mechanical processing (HIPping), with a grain size of 400 nm. The alloy with 0.45 wt % nitrogen of intrinsically formed nitrides resulted in an alloy, after thermo-mechanical processing, with a grain size of 200 nm. Thus, control of the nitride content had a dramatic effect on the grain size of the thermo-mechanically processed metals.

Example 3

Measured Correlation between Ultimate Tensile Strength and Nitrogen Content

Metal samples were prepared generally in accordance with the method outlined in Example 1, resulting in the compositions specified in Table 2. The data and graph was generated from readings taken at room temperature, about 20° C. Room temperature measurements tended to give a more accurate presentation of ductility, so they were used instead of readings at cryogenic temperatures.

TABLE 2

Comparison of aluminum alloy samples having differing nitrogen content vs. Ultimate Tensile Strength and Elongation.

| Sample ID # | $O_2$ | $N_2$ | C | $H_2$ | UTS rt | Elongation rt |
|---|---|---|---|---|---|---|
| 0 | 0.56 | 0.56 | 1691 | 54 | 102 | 1.5 |
| 1 | 0.38 | 0.54 | 1420 | 49 | 93.6 | 4.7 |
| 2 | 0.41 | 0.43 | 1221 | 41 | 90.6 | 4.9 |
| 3 | 0.51 | 0.65 | 1532 | 69 | 104 | 1 |
| 4 | 0.45 | 0.82 | 1749 | 69.5 | 101.2 | 1.3 |
| 5 | 0.35 | 0.75 | 1565 | 43 | 99.4 | 1.8 |
| 6 | 0.41 | 0.72 | 1590 | 52.5 | 99.3 | 1.7 |
| 7 | 0.24 | 0.46 | 1560 | 40.2 | 92.3 | 5.4 |
| 8 | 0.25 | 0.52 | 1443 | 32.8 | 91.5 | 6.4 |
| 9 | 0.24 | 0.56 | 1620 | 50.4 | 92.3 | 5 |
| 10 | 0.24 | 0.59 | 1670 | 40.9 | 96.2 | 5.7 |
| 11 | 0.25 | 0.58 | 1683 | 43.3 | 94.4 | 5.7 |
| 12 | 0.23 | 0.39 | 1687 | 40.4 | 88.4 | 5.7 |
| 13 | 0.18 | 0.29 | 1970 | 26.1 | 87 | 4.5 |
| 14 | 0.23 | 0.31 | 1828 | 27.8 | 89.5 | 4.3 |
| 15 | 0.23 | 0.32 | 2101 | 31.7 | 86 | 6.3 |
| 16 | 0.25 | 0.51 | 1687 | 37.9 | 96.5 | 4.2 |
| 17 | 0.21 | 0.37 | 1527 | 34.9 | 96.5 | 5.6 |
| 18 | 0.24 | 0.38 | 1503 | 43.1 | 89.2 | 3.4 |
| 19 | 0.21 | 0.32 | 1750 | 41.8 | 87.7 | 5.9 |
| 20 | 0.21 | 0.34 | 1653 | 36.4 | 78.3 | 14.19 |

Referring to FIG. 4, the ultimate tensile strength vs. nitrogen content for samples 0-20 from Table 2 above is plotted. The plotted results demonstrate that ultimate tensile strength of the alloys are linearly proportional to the nitrogen content of the alloy. Thus, the increased nitrogen content is shown to increase strengthening within the alloy by stopping dislocations within the grains and restraining grain growth.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An aluminum alloy consisting essentially of:
aluminum; and
intrinsic nitrides comprising a combination of nitrogen and at least one metal element having a negative enthalpy of formation with nitrogen, wherein the alloy has a nitrogen content that is less than about 1 wt %, and wherein the alloy has a ductility of at least 4% at room temperature, and wherein said alloy is free of oxy-nitrides.

2. The alloy of claim 1, wherein the least one metal element is selected from the group consisting of magnesium, lithium, molybdenum, chromium, vanadium, niobium, tantalum, titanium, zirconium, hafnium, and combinations thereof.

3. The alloy of claim 1, wherein the least one metal element is magnesium.

4. The alloy of claim 1, wherein the alloy has a nitrogen content is between 0.45 wt. % and 0.8 wt. %.

5. The alloy of claim 1, wherein the aluminum alloy has an ultimate tensile strength of at least 90 ksi at room temperature and a ductility of at least 4.5% at room temperature.

6. The alloy of claim 1, wherein grains of the aluminum alloy have a grain size less than 0.5 μm.

7. The alloy of claim 1, wherein grains of the aluminum alloy have a grain size less than 0.3 μm.

8. The alloy of claim 1, wherein the alloy has a ductility of at least 5.7% at room temperature.

9. An aluminum alloy consisting essentially of:
aluminum;
magnesium; and
intrinsic nitrides comprising a combination of nitrogen and magnesium, wherein the alloy has a grain size of less than 200 nm and a nitrogen content that is less than about 1 wt %, and wherein the alloy has a ductility of at least 4% at room temperature, and wherein said alloy is free of oxy-nitrides.

10. The aluminum alloy of claim 9, wherein the alloy has a ductility of at least 4.5% at room temperature.

11. The aluminum alloy of claim 9, wherein the alloy has a ductility of at least 5.7% at room temperature.

12. The aluminum alloy of claim 9, wherein the alloy has less than 0.24 wt. % oxygen.

13. The aluminum alloy of claim 9, wherein the alloy has an ultimate tensile strength of at least 90 ks at room temperature and a ductility of at least 4.5% at room temperature.

14. The aluminum alloy of claim 9, wherein the alloy has a nitrogen content is between 0.45 wt. % and 0.8 wt. %.

15. An aluminum alloy prepared by:
providing an aluminum alloy powder wherein the alloy consists essentially of aluminum and at least one metal component that has a negative enthalpy of formation with nitrogen;
cryomilling the alloy powder to form a cryomilled alloy;
forming intrinsic nitrides within the cryomilled alloy, wherein said alloy is free of oxy-nitrides; and controlling the duration of cryomilling so that the cryomilled alloy has a nitrogen content that is less than about 1 wt %, and wherein the cryomilled alloy has a ductility of at least 4% at room temperature.

16. The alloy of claim 15, wherein the at least one metal having a negative enthalpy of formation with nitrogen is selected from the group consisting of—magnesium, iron, molybdenum, chromium, vanadium, niobium, tantalum, titanium, zirconium, hafnium, and combinations thereof.

17. The alloy of claim 15, wherein the at least one metal having a negative enthalpy of formation with nitrogen is aluminum and wherein the step of forming intrinsic nitrides comprises the step of forming aluminum nitrides.

18. The alloy of claim 15, wherein the alloy has an average grain size less than 0.5 μm.

19. The alloy of claim 15, wherein the alloy comprises about 0.45% wt % to 0.8 wt % nitrogen.

20. The alloy of claim 15, wherein the alloy has a ductility of at least 5.7% at room temperature.

* * * * *